US005667265A

United States Patent [19]

Gebhard

[11] Patent Number: 5,667,265

[45] Date of Patent: Sep. 16, 1997

[54] RELEASABLE CARRYING HANDLE FOR BOTTLES

[76] Inventor: Albert W. Gebhard, 2101 E. Alameda, Denver, Colo. 80209

[21] Appl. No.: 635,391

[22] Filed: Apr. 25, 1996

[51] Int. Cl.[6] ..... B65D 23/10; B65G 7/12

[52] U.S. Cl. ..... 294/27.1; 294/169

[58] Field of Search ..... 294/15, 16, 27.1, 294/28, 31.2, 34, 87.2, 87.22, 87.28, 90–92, 137, 164–169; 215/396, 397; 220/752, 759, 760, 765, 769, 773; D9/434, 455

[56] References Cited

U.S. PATENT DOCUMENTS

| | | | |
|---|---|---|---|
| D. 277,080 | 1/1985 | Gagnon | D9/434 |
| D. 317,843 | 7/1991 | Gagnon | D9/455 |
| 1,336,049 | 4/1920 | Rix | 294/34 |
| 1,691,254 | 11/1928 | Robinson | 294/34 |
| 2,067,124 | 1/1937 | Hoffman | 294/87.28 |
| 2,534,512 | 12/1950 | Fulton | 294/28 |
| 2,814,404 | 11/1957 | Towns | 215/41 |
| 3,066,820 | 12/1962 | Faulstich | 215/41 |
| 3,155,263 | 11/1964 | Hidding | 215/100 |
| 3,275,366 | 9/1966 | Hidding | 294/31.2 |
| 4,579,237 | 4/1986 | Gagnon | 215/100 A |
| 5,085,477 | 2/1992 | Gagnon | 294/28 |

FOREIGN PATENT DOCUMENTS

| | | | |
|---|---|---|---|
| 165764 | 4/1950 | Austria | 294/27.1 |

*Primary Examiner*—Johnny D. Cherry
*Attorney, Agent, or Firm*—John E. Reilly

[57] ABSTRACT

A releaseable carrying handle for large water bottles of the type having an upper neck portion with an external shoulder at the entrance is made up of a neck-engaging cradle portion which is slidable horizontally into snug-fitting surrounding relation to the neck beneath the shoulder, and a rigid handle portion is pivotally connected to opposite sides of the cradle portion adjacent to its entrance, and ledges on opposite sides of the entrance assist in retaining the cradle portion on the neck of the bottle when carried.

13 Claims, 2 Drawing Sheets

RELEASABLE CARRYING HANDLE FOR BOTTLES

BACKGROUND AND FIELD OF INVENTION

This invention relates to handle supports; and more particularly relates to a novel and improved carrying handle which can be releasably secured to the upper neck portion of large bottles or containers for the purpose of carrying same in a reliable and efficient manner.

Water coolers typically employ five-gallon containers of the type having an upper neck portion with an external shoulder at the entrance. A bottle cap is releasably but securely placed over the entrance to seal off the contents when the container is being stored. It has been proposed in the past to employ releasable handles which can be slipped into engagement with the upper neck portion to facilitate lifting and carrying of the containers and, for example, reference is made to U.S. Pat. Nos. 3,155,263 to W. E. Hidding and 4,579,237 to P. L. Gagnon. Hidding discloses a flexible handle which is broadly comprised of a continuous band which encircles the neck portion and a flexible handle secured in surrounding relation to the band with a hand grip which normally projects away from the neck portion in a horizontal direction but when grasped can be raised into a substantially vertical portion when the bottle is lifted. Gagnon in turn is directed to the combination of a specially designed bottle cap and a one-piece handle having a cradle portion to releasably engage the cap and a vertically directed, hand grip which can be grasped by the user or carrier.

It is proposed to improve bottle carriers of the type described by providing a lower rigid cradle portion which is conformable for use on different neck as well as bottle cap configurations and a rigid handle portion which is foldably connected to the cradle portion in such a way as to be movable into a compact position overlying the cradle when not in use and easily raised into a substantially vertical position extending upwardly from the cradle to afford optimum balance in lifting and carrying the container.

SUMMARY OF THE INVENTION

It is therefore an object of the present invention to provide for a novel and improved carrying handle for bottles and particularly larger jug-like containers to facilitate transportation to different sites of use.

Another object of the present invention is to provide for a novel and improved bottle carrier having a rigid neck-engaging portion and which will achieve optimum balance and leverage in lifting and carrying larger bottles or containers.

A further object of the present invention is to provide in a bottle carrier for a novel and improved hand grip which is foldably connected to a cradle-like support for releasable attachment to a bottle in carrying same from site to site.

In accordance with the present invention, a preferred form resides in a bottle carrier for carrying a bottle of the type having an upper neck portion at its entrance and an outer surrounding cap removably positioned over the neck portion, the carrier comprising a neck or cap-engaging cradle portion of generally U-shaped configuration which is slidable horizontally into snug-fitting surrounding relation to the neck between the shoulder, and a rigid handle portion includes a hand grip and opposite side arm members affixed to opposite ends of the hand grip, and free ends of the side arm members being pivotally connected to the cradle portion.

In the preferred form, the handle portion is pivotal from a position overlying the cradle portion to a raised position above the cradle portion for achieving optimum leverage and balanced engagement with the bottle. Furthermore, the cradle portion has a cap-receiving opening with an inner surrounding edge to insure positive but releasable engagement with the cap.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
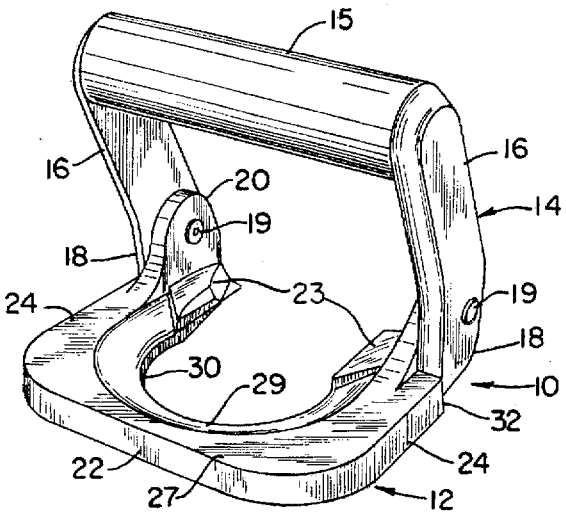
FIG. 1 is a perspective view of a preferred form of the invention in an open, bottle-carrying position.

Referring in more detail to the drawings, there is illustrated in FIGS. 1 to 8 a preferred form of bottle carrier 10 which is broadly comprised of a neck or cap-engaging cradle portion 12, and a rigid handle portion 14. The handle portion includes a hand grip 15 and opposite side arm members 16 extending from opposite ends of the hand grip and terminating in free ends 18 which are pivotally connected by pins 19 to upstanding ears 20 at one end of the cradle portion.

Considering in more detail the construction and design of the cradle portion 12, it is of generally U-shaped configuration having a rounded closed end 22. Opposite, substantially straight sides 24 extend forwardly from the closed end 22 to terminate in entrance portions 23 and wherein the closed end 22 and sides 24 together define a neck or cap-receiving opening 25. The closed end 22 and sides 24 are provided with spaced parallel upper and lower wall surfaces 27 and 28, respectively, and an inclined surface 29 tapers downwardly from the upper wall surface 27 to terminate in a common edge 30 between the surface 29 and lower wall surface 28 which surrounds the opening 25, as best seen from FIG. 8.

Figure 4:
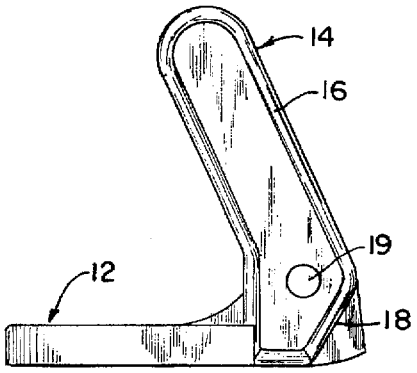
FIG. 4 is a side view in elevation of the preferred form of invention.
Figure 5:
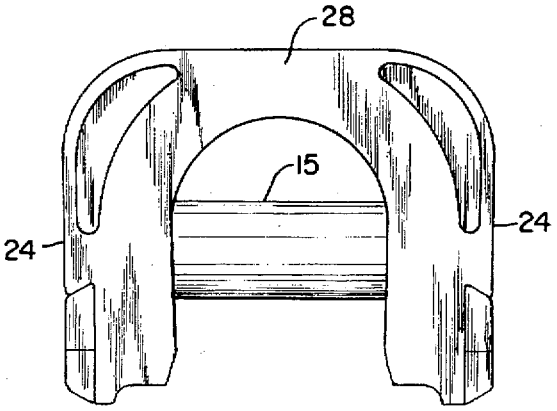
FIG. 5 is a bottom plan view of the preferred form of invention.
Figure 6:
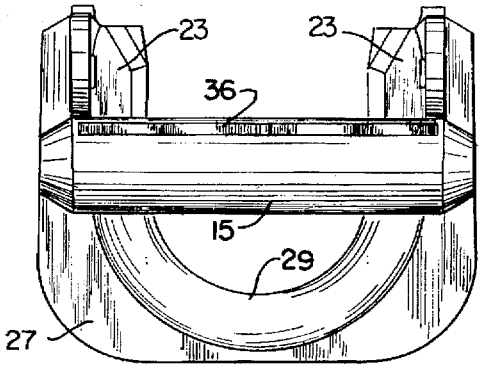
FIG. 6 is a top plan view of the preferred form of invention.
Figure 8:
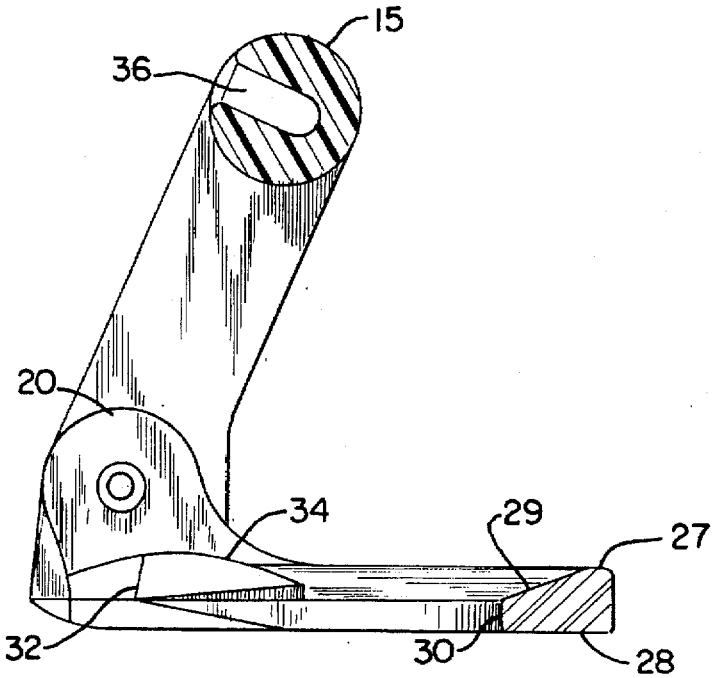
FIG. 8 is an opposite side view partially in section of a preferred form of invention.

The opposite sides 24 of the cradle portion 12 have stop portions 32 outwardly of each respective ear 20 and against which the lower free ends 18 abut when in the raised, bottle-carrying position. As shown in FIGS. 4 and 8, the free ends 18 are angled downwardly and forwardly with respect to the side arm members 16 so that when the free ends 18 move into abutment with the stop members 32, the arm members 16 are constrained to extend upwardly at an angle slightly less than 90° to the cradle portion 12. For example, the angle between the side arm members 16 and vertical is preferably on the order of 65° to 75°.

Figure 7:
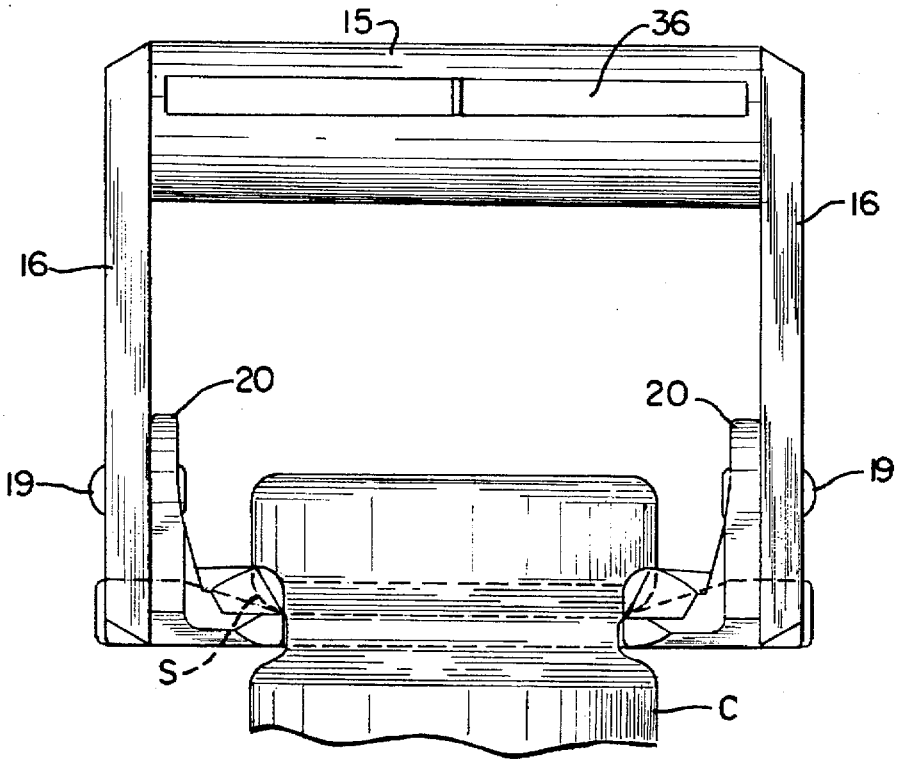
FIG. 7 is a front view in elevation of the preferred form of invention shown engaging a cap on a bottle.

As shown from a further consideration of FIGS. 7 and 8, each of the entrance portions 23 includes a raised, generally convex surface portion or ledge 34 on the upper wall surface 27 extending rearwardly from the forward or open end of the cradle portion and terminating at a point just beyond or rearwardly of the ears 20. Accordingly, when the cradle portion is advanced into engagement with an upper neck portion of a bottle, such as, into engagement with a cap designated at C in FIG. 7 which surrounds the neck beneath a shoulder portion S at the entrance to the bottle, it is necessary to slide the neck over the ledges 34 on opposite sides of the entrance and then to slide rearwardly into engagement with the tapered wall surface 29. In this way, the upper neck portion of the bottle will become firmly wedged between the tapered wall surface 29 and rearwardly and downwardly sloping portions of the ledges 34 to minimize any possibility of accidentally slipping off of the carrier when lifted or carried.

Figure 2:
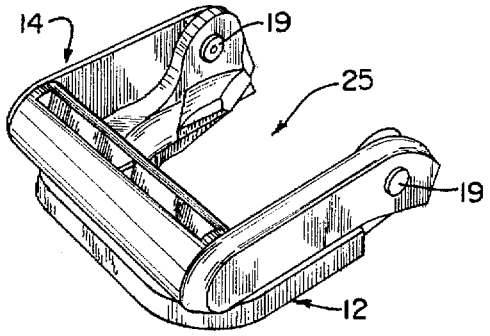
FIG. 2 is another perspective view of the preferred form of invention in a closed storage position.
Figure 3:
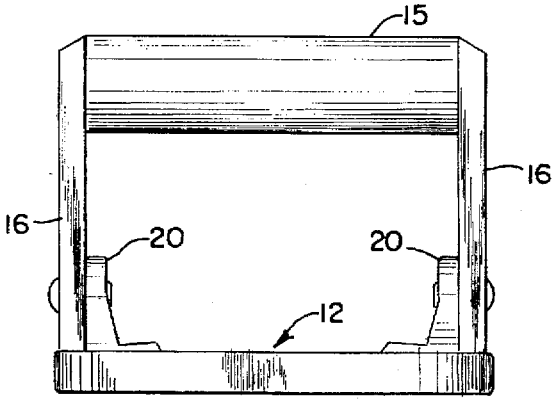
FIG. 3 is a rear view in elevation of the preferred form.

Preferably, the hand grip is of a generally circular cross-sectional configuration and provided with an elongated recess 36 at spaced intervals to enhance the gripping action when the hand encircles the hand grip 15. When not in use, the handle portion 14 can be folded or pivoted into overlying relation to the cradle portion, as shown in FIG. 2, so that the handle portion 14 is substantially coextensive with the cradle portion 12 and extremely compact for ease of storage and shipment. In order to apply to the neck of the bottle, the handle 16 is unfolded or raised upwardly from the cradle portion 12 and the neck of the bottle is passed through the entrance 23 over the stop portions 32 so as to substantially clear the convex surfaces 34 and rest snugly on the inclined wall surface 29. In this relation, the opening 25 is dimensioned such that the edge 30 is of a lesser size or dimension extending between the straight sides 24 than the upper shoulder S of the bottle. In this relation, the bottle carrier 10 is preferably composed of a hard plastic material which is inflexible or non-resilient. Further, the lateral dimension between the sides 24 is such that the bottle-receiving opening 25 will accommodate standard caps, such as, the cap C shown in FIG. 7 which are conventionally used to seal the bottle opening. Of course, the bottle carrier may be furnished in different sizes to accommodate different sized bottle necks; and, when in position on the bottle neck, the handle portion 14 extends upwardly and slightly rearwardly as described so as to be substantially centered over the center of mass of the bottle.

It is therefore to be understood that while a preferred form of invention has been herein set forth and described various modifications and changes may be made in the construction and arrangement of parts as well as their composition without departing from the spirit and scope of the present invention as defined by the appended claims.

I claim:

1. A bottle carrier for carrying bottles of the type having an entrance therein, and an upper neck and an external shoulder portion around said entrance, said carrier comprising:

a neck-engaging cradle portion of generally U-shaped configuration comprising:

a closed end;

two sides extending from said closed end, wherein said closed end and said sides define a neck-receiving opening, and said sides are slidable transversely of said neck into snug-fitting, surrounding relation to said neck beneath said shoulder portion; and stop members on said sides; and a rigid handle portion having a hand grip and opposite side arm members extending from opposite ends of said hand grip, said arm members being pivotally connected to said cradle portion;

wherein said side arm members are abuttable with said stop members to limit upward pivotal movement of said handle portion to an attitude less than 90° with respect to said cradle portion.

2. A bottle carrier according to claim 1, said handle being pivotal between a substantially horizontal position overlying said cradle portion and a position extending upwardly from said cradle portion.

3. A bottle carrier according to claim 1, further comprising a tapered side wall converging inwardly into a neck-engaging edge surrounding said neck-receiving opening.

4. A bottle carrier according to claim 3, said neck-engaging edge being of generally U-shaped configuration and said tapered wall having ledges at free ends thereof which define an entrance for insertion of said neck.

5. A bottle carrier according to claim 4, wherein said ledges each include an upper convex surface portion extending rearwardly from said entrance for insertion of said neck.

6. A bottle carrier according to claim 1, wherein said opposite side arm members of said handle portion are pivotally connected to said cradle portion on opposite sides of said neck-receiving opening.

7. A bottle carrier according to claim 6, wherein said cradle portion includes upstanding ears on opposite sides of said neck-receiving opening for pivotal connection to free ends of said side arm members.

8. A bottle carrier for carrying bottles of the type having an an entrance therein and an upper neck with an external shoulder around said entrance and an outer surrounding cap removably positioned over said shoulder, said carrier comprising:

a neck-engaging cradle portion of generally U-shaped configuration comprising:

a closed end;

two sides extending from said closed end, wherein said closed end and said sides define a neck-receiving opening, and said sides are slidable transversely of said neck into snug-fitting, surrounding relation to said cap; and stop members on said sides; and a rigid handle portion having a hand grip and opposite side arm members extending from opposite ends of said hand grip, said side arm members being pivotally connected to said cradle portion;

wherein said side arm members are abuttable with said stop members to limit upward pivotal movement of said handle portion to an attitude less than vertical with respect to said cradle portion.

9. A bottle carrier according to claim 8, said handle portion being pivotal between a substantially horizontal position overlying said cradle portion and a position extending upwardly from said cradle portion.

10. A bottle carrier according to claim 8, wherein said cradle portion includes a tapered side wall converging inwardly into a neck-engaging edge surrounding said neck-receiving opening, said edge being of generally U-shaped configuration and said tapered wall having ledges at free ends thereof which define an entrance for insertion of said cap.

11. A bottle carrier according to claim 10, wherein said ledges each include an upper surface portion sloping rearwardly and downwardly from the entrance for insertion of said cap to said neck-receiving edge.

12. A bottle carrier according to claim 8, wherein said opposite side arm members of said handle portion are pivotally connected to ears extending upwardly from said sides on opposite sides of said neck-receiving opening.

13. A bottle carrier according to claim 8, wherein said cradle portion and said handle portion are composed of an inflexible plastic material.

* * * * *